United States Patent [19]

Ditton

[11] Patent Number: 4,493,462

[45] Date of Patent: Jan. 15, 1985

[54] SPOOL WITH LIFTING HANDLES

[75] Inventor: Louis G. Ditton, Ft. Wayne, Ind.

[73] Assignee: Essex Group, Inc., Fort Wayne, Ind.

[21] Appl. No.: 601,511

[22] Filed: Apr. 18, 1984

[51] Int. Cl.[3] ..... B65H 75/40

[52] U.S. Cl. ..... 242/118.61; 242/85.1; 242/96

[58] Field of Search ..... 242/96, 118.4–118.8, 242/71.8, 71.9, 85.1, 129; 206/389–391, 408

[56] References Cited

U.S. PATENT DOCUMENTS

| | | | |
|---|---|---|---|
| 1,408,261 | 2/1922 | Brookhart | 242/85.1 |
| 2,508,809 | 5/1950 | Allen | 242/96 |
| 2,944,759 | 7/1960 | Donovan | 242/129 |
| 3,033,360 | 5/1962 | Ledoux | 242/171 |
| 3,334,841 | 8/1967 | Burhop | 242/118.61 |
| 3,406,817 | 10/1968 | Lane et al. | 206/408 |
| 4,140,289 | 2/1979 | Kovaleski | 242/118.6 |
| 4,253,569 | 3/1981 | O'Connor et al. | 206/391 |

*Primary Examiner*—Leonard D. Christian
*Attorney, Agent, or Firm*—Robert D. Sommer

[57] ABSTRACT

A molded plastic spool for the shipping, storage and handling of a substantial weight of wire which comprises bottom and top end flanges at respective bottom and top ends of a tubular barrel. A radially inwardly extending end plate at the top end of the barrel has two pairs of generally U-shaped finger-receiving handles formed integrally therewith for two-handed manual lifting of the spool.

6 Claims, 4 Drawing Figures

FIG. 3
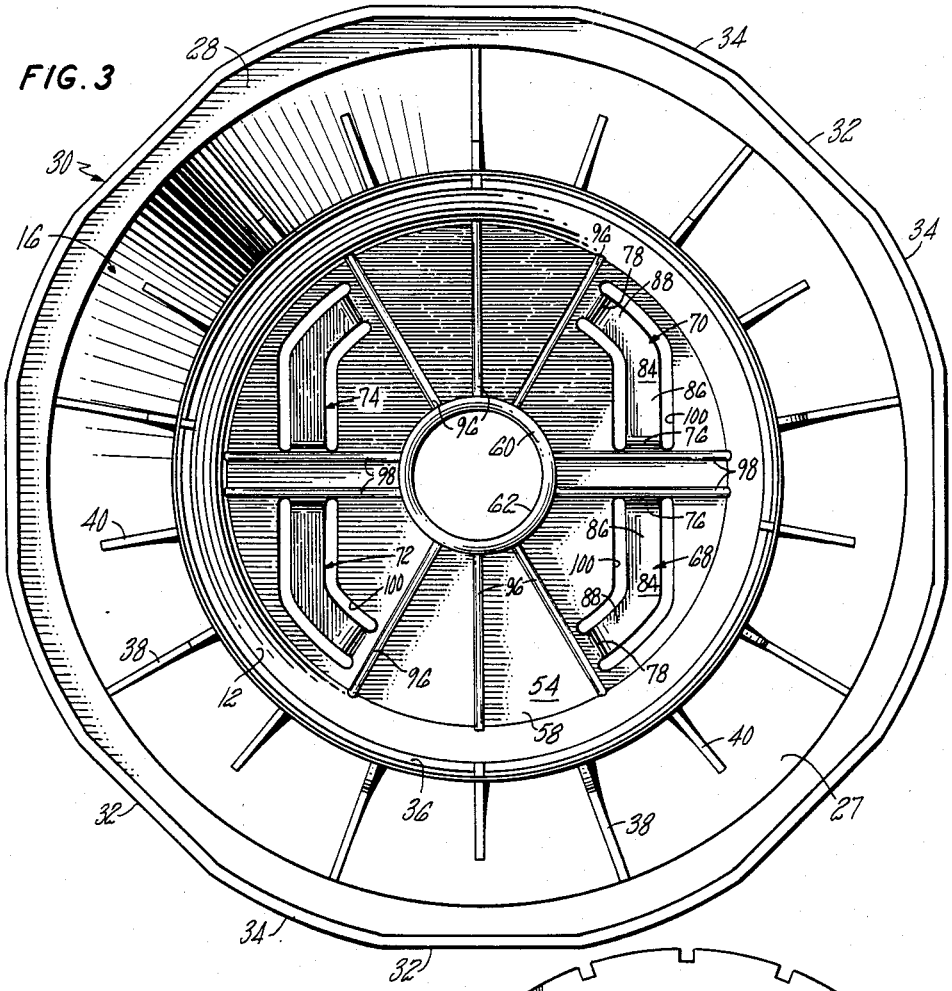
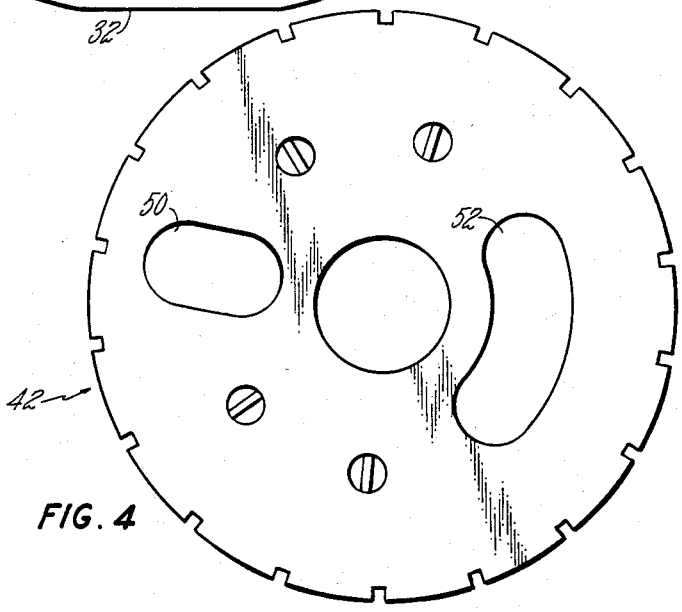
FIG. 4

SPOOL WITH LIFTING HANDLES

FIELD OF THE INVENTION

This invention relates to a spool for wire, and more particularly to a molded plastic spool for holding a substantial weight of wire that is provided with handles for manual lifting and carrying of the spool.

BACKGROUND OF THE INVENTION

In the magnet wire industry, it is common practice to supply wire wound on molded plastic spools having a barrel with two end flanges. Such plastic spools loaded with substantial weights of wire are ordinarily shipped, stored and handled with one end flange resting on a supportive surface. To permit lifting and transporting of this type of spool with a hoist, it is known to provide the spool with a rigid bar or rod disposed along the longitudinal axis of the spool and having at its upper end a ring or eye adapted to receive a suitable hook. Examples of spools of this type of lifting structure are shown in Kovaleski U.S. Pat. No. 4,140,289 and the O'Connor et al U.S. Pat. No. 4,253,569. It is also known, as shown by the Donovan U.S. Pat. No. 2,944,759, to secure a plate-like lifting handle to a wire-carrying drum transversely of the drum's longitudinal axis. Many wire users, however, prefer smaller spools which weigh about 35 kilograms when loaded and thus can be manually lifted and carried about without use of a hoist. To facilitate manual lifting of such spools, it would be desirable to provide the spools with lifting handles which could be grasped by human hands.

As shown by the Brookhart U.S. Pat. No. 1,408,261 and the Alten U.S. Pat. No. 2,508,809, it is old to provide a spool or reel with a manually grippable handle for lifting and carrying purposes. The Lane et al U.S. Pat. No. 3,406,817 discloses a molded plastic container for magnet wire which is formed with an integral lifting handle extending transversely across the end of a tubular inner wall. The employment of such a single lifting handle with a spool bearing a substantial weight such as 35 kilograms of wire is disadvantageous since it can be conveniently grasped with only one hand. A single plastic handle of the type disclosed in U.S. Pat. No. 3,406,817 would also tend to fracture when used to lift a spool loaded with more than 30 kilograms of wire.

A further disadvantage of prior lifting handle arrangements for wire spools is that the handle extends transversely across the longitudinal axis of the spool. Wire is commonly wound onto and dispensed from spools by processing machines having a spindle inserted into centrally located bushing portions of the spools. Accordingly, a spool having a handle extending transversely across its longitudinal axis could not be utilized with all customary types of wire processing machines.

SUMMARY OF THE INVENTION

The present invention provides an improved molded plastic spool with integral handles which substantially overcomes all of the above-mentioned disadvantages yet is durable in use and economical to manufacture. The spool comprises a one-piece integrally molded body which includes a substantially tubular barrel and annular top and bottom end flanges. The bottom end flange has a reinforced portion for bearing the weight of wire carried by the spool when the spool is in an upright position. An end plate at the top end of the barrel comprises a radially inwardly extending reinforced disc having an outer side facing away from the barrel. Two pairs of generally U-shaped finger-receiving handles are formed integrally with the end plate in diametrically opposed relationship around the spool axis. The pairs of handles are substantially mirror images of each other through a plane coincident with the spool axis and are arranged to be engaged by right-hand and left-hand fingers, respectively, for two-handed lifting of the spool. The barrel is structurally interconnected with the end plate and the bottom end flange for transferring the weight of wire carried by the spool to the handles.

In a preferred embodiment of the invention, the end plate includes an axially extending bushing at its center and strengthening ribs extending generally radially outwardly from the bushing to structurally reinforce the end plate at the junctures of the handles with the end plate. The top end flange preferably is of an out-turned truncated conical configuration and the pairs of handles are located entirely within the confines of the top end flange to permit the bottom flange of a like spool to be seated on the top end flange when the spools are stacked in end-to-end relation.

For a better understanding of the invention, reference may be had to the following detailed description taken in connection with the accompanying drawings, in which:

BRIEF DESCRIPTION OF THE DRAWINGS

FIG. 3 is a view taken on line 3—3 of FIG. 2; and

FIG. 4 is a view taken on line 4—4 of FIG. 2.

DETAILED DESCRIPTION

Figure 1:
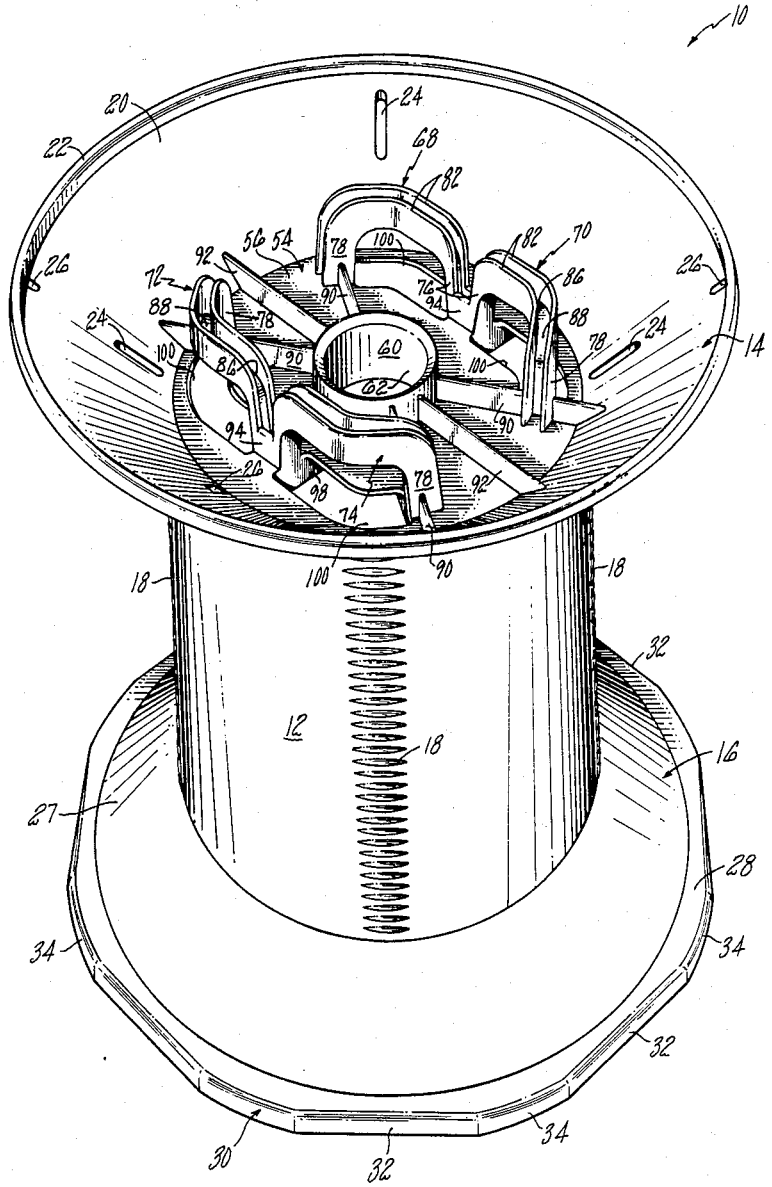
FIG. 1 is a perspective view of a spool constructed in accordance with the invention.
Figure 2:
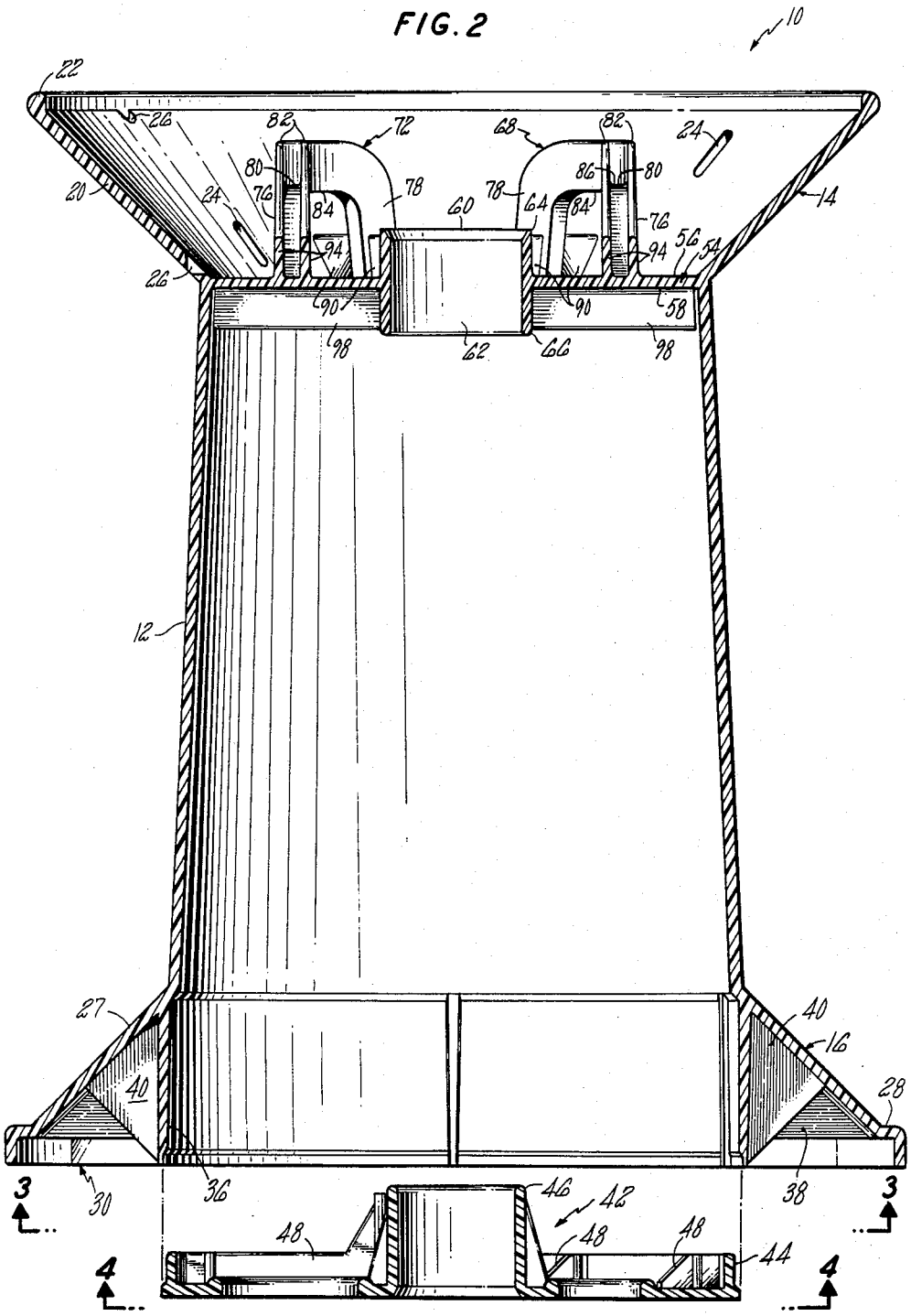
FIG. 2 is a cross-sectional view showing the spool of FIG. 1 and a bushing insert therefore in exploded relation.

Referring to the drawings, a spool 10 according to the present invention comprises a one-piece integrally molded plastic shell having a tubular, tapered barrel 12 with tapered or outwardly flared top and bottom end flanges 14 and 16, respectively, at its opposite ends to define a space accommodating wire wound about the barrel. The outer surface of the barrel 12 is formed with four circumferentially spaced groups of axially spaced serrations 18. The serrations 18 are equally spaced along the barrel but those of one group are axially displaced slightly from those of the two adjoining groups. The serrations 18 act to prevent the initial layers of wire wound onto the barrel from slipping downwardly toward the bottom end flange 16.

The top end flange 14 extends radially outwardly from the top end of the barrel 12 and comprises a thin-walled frustro-conical body 20 of substantially uniform thickness with an enlarged peripheral rim 22 of rounded profile at its outer larger end. The body 20 may be provided with a few elongated inspection opening 24 and a few small holes 26 for receiving the start and finish ends of wire wound about the barrel 12.

The bottom end flange 16 extends radially outwardly from the bottom end of the barrel 12 and includes a frustro-conical body 27 and an annular radially extending collar 28 at the outer periphery of the body 27 which terminates in an axially extending polygonal rim 30. The rim 30 preferably comprises eight identical flat surfaces 32 equally spaced around the periphery thereof and joined to each other by convex surfaces 34 formed on the arc of a circle whose center is the longitudinal axis of the spool 12. The flat surfaces 32 lie along chords of the same circle to prevent relative rotation between two or more like spools when placed in side by side relationship. The rim 30 is sized to receive therein the rim 22 of the top end flange 14 of a like spool. Thus, two like spools may be stacked in stable end-to-end relation with the collar 28 of one spool resting upon the rim 22 of the other spool.

A cylindrical tube 36 integral with and extending axially from the bottom end of the barrel 12 terminates in the same plane as the outer end of the rim 30. To make rigid the body 27 of the bottom end flange 16 and to reinforce it for bearing the weight of wire wound about the barrel 12, a plurality of evenly spaced support ribs 38 and gusset ribs 40 extend radially between the outer surface of the tube 36 and the axially outer surface of the body 27. If desired, a bushing insert 42 of generally disc-like configuration may be adhesively bonded or otherwise attached to the outer end of the tube 36. The insert 42 includes a peripheral ring portion 44 and an elongated central bushing 46 which project into the tube 36. For reinforcing the insert 42, the ring portion 44 and the bushing 46 are integrally connected with each other by radial ribs 48 which are also formed integrally with the inner surface of the insert 42. The insert 42 is further provided with elongated driving slots 50 and 52 for receiving spool rotating elements of conventional winding apparatus (not shown).

At the upper end of barrel 12, an end plate 54 comprising a reinforced, substantially rigid disc extends radially inwardly and has respective outwardly and inwardly facing sides 56 and 58. The end plate 54 is formed at its center with an axially extending cylindrical bushing 60 which has an inner cylindrical bearing surface 62 aligned with that of the bushing 46. Opposite ends 64 and 66 of the bushing 60 project from the sides 56 and 58, respectively, of the end plate 54.

Integrally joined to the outer side 56 of the end plate 54 are two pairs of generally U-shaped finger-receiving handles 68, 70 and 72, 74 which project axially outwardly from the end pate 54 in diametrically opposed relationship about the longitudinal axis of the spool 10. Furthermore, the one pair of handles 68 and 70 is substantially a mirror image of the other pair of handles 72 and 74 through a plane coincident with the longitudinal axis of the spool 10. Each handle comprises to spaced apart uprights 76 and 78 depending at their respective inner end from the end plate 54 in a direction generally parallel to the longitudinal axis of the spool. The uprights 76 and 78 of each handle are connected at their outer ends by a crosspiece 80 which is laterally spaced from the end plate 54. Each of the handles 68, 70, 72 and 74 are channel-shaped in cross section with parallel side sections 82 projecting outwardly at right angles from a base section 84.

The two pairs of handles are arranged to be engaged by right-hand and left-hand fingers, respectively, for two-handed lifting of the spool 10. The uprights 76 of the handles 68 and 70 thus are closely spaced and in alignment with each other at one location while the uprights 76 of the other handles 72 and 74 are similarly closely spaced and in alignment with each other at a diametrically opposite location. Also, each handle has its upright 78 disposed at an acute angle relative to its other upright 76 and spaced further from the longitudinal axis of the spool 10. It is to be noted that the uprights 78 of the handles 68 and 74 are in diametrically opposed relationship and that the uprights 78 of the handles 70 and 72 are in diametrically opposed relationship. Each crosspiece 80 is preferably constituted of two portions 86 and 88 which extend generally perpendicularly from respective uprights 76 and 78 and are disposed at an angle to one another.

The end plate 54 is reinforced by radially extending strengthing ribs 90 and 92 integrally formed on the outer side 56 thereof. Each of the ribs 90 extends from the bushing 60 to the upright 78 of a respective one of the handles 68, 70,72 and 74 and thence to the body 20 of the top end flange 14. The ribs 92 extend in opposite directions from the bushing 60 to the body 20 along a plane midway between the two pairs of handles 68, 70 and 72, 74. Also integrally formed on the outer side 56 of the end plate 54 are webs 94 which extend between respective side sections 82 of adjacent uprights 76. Additional radially extending strengthening ribs 96 are integrally formed on the inner side 58 of the end plate 54 and extend between the bushing 60 and the barrel 12 along planes coextensive with the respective ones of the ribs 90 and 92. Two pairs of ribs 98 also integrally formed on the inner side 58 of the end plate 54 extend generally radially in opposite directions from the bushing 60 to the barrel 12 across corresponding portions of the end plate 54 to which the uprights 76 are joined.

The entire spool 10 including the barrel 12, the end flanges 14 and 16, the tube 36, the end plate 54 and the handles 68, 70, 72 and 74 may be economically molded as one piece from suitable plastic materials such as polystyrene or polyethylene. To facilitate the molding of the handles, the end plate 54 may be formed with four openings 100 therein underlying the crosspieces 80 of the handles. If required, the bushing insert 42 may be attached to the tube 36 following molding of the spool.

The spool 10 of the present invention can be wound with wire by conventional winding apparatus. After being wound with wire, the spool may be shipped, stored and handled with the bottom end flange 16 seated upon a horizontal support surface. For manual lifting of the spool, one or two right-hand fingers may be inserted through each of the handles 68 and 70 and one or two left-hand fingers may be inserted through each of the handles 72 and 74. Upon lifting of the spool 10, the weight of wire carried by the spool is transferred to the handles by the structural interconnection of the barrel 12 with the end plate 54 and the bottom end flange 16. Because the handles 68, 70, 72 and 74 are located entirely within the confines of the top end flange 14, the bottom end flange 16 of a like spool may be seated on the top end flange 14 when the spools are stacked in end-to-end relations.

While there has been described above the principles of this invention in connection with a specific spool construction, it is to be understood that this description is made only by way of example and not as a limitation to the scope of the invention.

What is claimed is:

1. A one-piece integrally molded plastic spool for the shipping, storage and handling of a substantial weight of metal wire comprising:

a substantially tubular barrel having a longitudinal axis;

an annular top end flange extending radially outwardly from one end of said barrel and an annular bottom end flange extending radially outwardly from the other end of said barrel to define with said barrel a space for wire wound about said barrel;

said bottom end flange having a reinforced, substantially rigid portion for bearing the weight of wire wound about the barrel when said bottom end flange is seated upon a horizontal support surface;

an end plate located at said one end of the barrel and comprising a reinforced, substantially rigid disc extending radially inwardly from said one end of the barrel and having one side facing away from said barrel and an opposite inner side; and first and second pairs of generally U-shaped finger-receiving handles formed integrally with said end plate and projecting axially outwardly from said one side of the end plate in diametrically opposed relationship around said longitudinal axis; said pairs of handles being substantially mirror images of each other through a plane coincident with said longitudinal axis and arranged to be engaged by right-hand and left-hand fingers, respectively, for two-handed lifting of the spool; said barrel being structurally interconnected with said end plate and said bottom end flange for transferring the weight of wire carried by the spool to said pairs of handles.

2. The spool of claim 1 wherein said top end flange is of an out-turned truncated conical configuration; said pairs of handles being located entirely within the confines of said top end flange.

3. The spool of claim 1 wherein each of said handles comprises first and second spaced apart uprights depending at their respective inner ends from said end plate in a direction generally parallel to said longitudinal axis and connected at their outer ends with a crosspiece which is laterally spaced from said end plate; each of said handles being channel-shaped in cross section with side sections projecting outwardly at right angles from a base section.

4. The spool of claim 3 wherein said pairs of handles are arranged with corresponding first uprights of each pair being closely spaced and in alignment with each other; the second uprights of one pair of said handles being in diametrically opposed relationship with the respective second uprights of the other pair; the second upright of each handle being disposed at an acute angle relative to the first upright thereof and located further from said longitudinal axis than said first upright; each of said crosspieces being constituted by two portions which are disposed at an angle to one another so as to extend generally perpendicularly from respective first and second uprights.

5. The spool of claim 4 wherein said end plate is formed at its center with an axially extending cylindrical bushing having opposite ends projecting respectively from said one side and said opposite inner side of said end plate; said end plate having first and second radially extending strengthening ribs formed on said one side thereof; each of said first ribs extending in opposite directions from said bushing to a corresponding one of said second uprights and thence to said top end flange; said second ribs extending in opposite directions from said bushing to said top end flange along a plane midway between said first and second pairs of handles; said end plate having third radially extending ribs formed on said inner opposite side thereof and extending between said bushing and said barrel along planes coextensive with respective ones of said first and second ribs; said end plate having two pairs of fourth ribs formed on said opposite inner side thereof and extending generally radially in opposite directions from said bushing to said barrel across corresponding portions of said end plate to which are joined the closely spaced first uprights of said first and second pairs of handles, respectively; the first uprights of each said pair of handles being interconnected by webs formed on said one side of the end plate and extending between respective side sections of said first uprights.

6. The spool of claim 5 wherein said top end flange comprises an outwardly flaring, frustro-conical body and an enlarged peripheral rim at the outer larger end of the body; said pairs of handles being located entirely within the confines of said top end flange to permit the bottom end flange of a like spool to be seated on said peripheral rim when the spools are stacked in end-to-end relation.

* * * * *